US009251987B2

(12) United States Patent
Zhang et al.

(10) Patent No.: US 9,251,987 B2
(45) Date of Patent: Feb. 2, 2016

(54) EMISSION SURFACE FOR AN X-RAY DEVICE

(75) Inventors: Xi Zhang, Ballston Lake, NY (US); Carey Shawn Rogers, Brookfield, WI (US); Ethan James Westcot, Milwaukee, WI (US); Mark Alan Frontera, Ballston Lake, NY (US); Vance Scott Robinson, Niskayuna, NY (US); Yun Zou, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 301 days.

(21) Appl. No.: 13/619,587

(22) Filed: Sep. 14, 2012

(65) Prior Publication Data

US 2014/0079187 A1 Mar. 20, 2014

(51) Int. Cl.

| | |
|---|---|
| ***H01J 1/16*** | (2006.01) |
| ***H01J 25/06*** | (2006.01) |
| ***H01J 35/06*** | (2006.01) |

(52) U.S. Cl.

CPC . *H01J 1/16* (2013.01); *H01J 35/06* (2013.01); *H01J 2235/1212* (2013.01)

(58) Field of Classification Search

CPC ..... H01J 1/16
USPC ..... 378/136; 313/344
See application file for complete search history.

(56) References Cited

U.S. PATENT DOCUMENTS

| | | | | |
|---|---|---|---|---|
| 4,795,940 | A * | 1/1989 | Leung et al. | 313/346 R |
| 5,343,112 | A * | 8/1994 | Wegmann et al. | 313/346 R |
| 6,115,453 | A | 9/2000 | Hell et al. | |
| 6,426,587 | B1 | 7/2002 | Hell et al. | |
| 6,624,555 | B2 | 9/2003 | Hell et al. | |
| 6,646,366 | B2 | 11/2003 | Hell et al. | |
| 7,693,265 | B2 | 4/2010 | Hauttmann et al. | |
| 7,801,277 | B2 | 9/2010 | Zou et al. | |
| 2001/0052743 | A1 * | 12/2001 | Hell | H01J 35/06 313/341 |
| 2003/0025429 | A1 * | 2/2003 | Hell et al. | 313/310 |
| 2008/0187093 | A1 * | 8/2008 | Price et al. | 378/19 |
| 2009/0323898 | A1 * | 12/2009 | Moore | 378/136 |
| 2010/0176708 | A1 * | 7/2010 | Hauttmann | H01J 1/15 313/310 |
| 2010/0195797 | A1 | 8/2010 | Hauttmann et al. | |
| 2010/0207508 | A1 * | 8/2010 | Terletska | H01J 1/13 313/341 |
| 2010/0316192 | A1 | 12/2010 | Hauttmann et al. | |
| 2012/0090300 | A1 * | 4/2012 | Champoux et al. | 60/274 |

FOREIGN PATENT DOCUMENTS

| | | | |
|---|---|---|---|
| GB | 524240 | A | 8/1940 |
| WO | 2009013677 | A1 | 1/2009 |
| WO | 2009013685 | A1 | 1/2009 |

* cited by examiner

*Primary Examiner* — Jack Berman
*Assistant Examiner* — Eliza Osenbaugh-Stewar
(74) *Attorney, Agent, or Firm* — Melissa K. Dobson

(57) ABSTRACT

Embodiments of the disclosure relate to electron emitters for use in conjunction with X-ray devices. In one embodiment, the emitter features a round emission area capable of emitting electrons when heated, wherein the round emission area comprises at least one of a gap, a channel, or a combination thereof that separates a first portion of the round emission area from a second portion of the round emission area and permits thermal expansion of the first portion and the second portion within the at least one gap or channel without permitting the first portion and the second portion to touch one another. The two electrically conductive legs coupled to the surface at respective locations outside the round emission area and that are capable of supplying current to the round emission area.

23 Claims, 4 Drawing Sheets

EMISSION SURFACE FOR AN X-RAY DEVICE

BACKGROUND

The subject matter disclosed herein relates to electron emission surfaces, such as for use in an electron gun.

In non-invasive imaging systems, X-ray tubes are used in various X-ray systems and computed tomography (CT) systems as a source of X-ray radiation. The radiation is emitted in response to control signals during an examination or imaging sequence. Typically, the X-ray tube includes a cathode and an anode. An emitter within the cathode may emit a stream of electrons in response to heat resulting from an applied electrical current, and/or an electric field resulting from an applied voltage to a properly shaped metallic plate in front of the emitter. The anode may include a target that is impacted by the stream of electrons. The target may, as a result of impact by the electron beam, produce X-ray radiation to be emitted toward an imaged volume.

In such imaging systems, the radiation passes through a subject of interest, such as a patient, baggage, or an article of manufacture, and a portion of the radiation impacts a digital detector or a photographic plate where the image data is collected. In digital X-ray systems a photodetector produces signals representative of the amount or intensity of radiation impacting discrete elements of a detector surface. The signals may then be processed to generate an image that may be displayed for review. In CT systems a detector array, including a series of detector elements, produces similar signals through various positions as a gantry is rotated about a patient.

In other systems, such as systems for oncological radiation treatment, a source of X-rays may be used to direct ionizing radiation toward a target tissue. In some radiation treatment configurations, the source may also include an X-ray tube. X-ray tubes used for radiation treatment purposes may also include a thermionic emitter and a target anode that generates X-rays, such as described above. Such X-ray tubes or sources may also include one or more collimation features for focusing or limiting emitted X-rays into a beam of a desired size or shape.

BRIEF DESCRIPTION

In one embodiment, an X-ray emitter is provided. The X-ray emitter includes a round emission area capable of emitting electrons when heated. The round emission area includes a surface comprising a round emission area capable of emitting electrons when heated, wherein the round emission area comprises at least one of a gap, a channel, or a combination thereof that separates a first portion of the round emission area from a second portion of the round emission area and permits thermal expansion of the first portion and the second portion within the at least one gap or channel without permitting the first portion and the second portion to touch one another. The round emission area also includes two electrically conductive legs coupled to a surface of the emitter at respective locations outside the round emission area and that are capable of supplying current to the round emission area.

In another embodiment, an X-ray emitter is provided. The X-ray emitter includes a disc-shaped emission area capable of emitting electrons when heated with a driving current of 10 A or less. The disc-shaped emission area includes two electrically conductive legs coupled to the surface at respective locations outside the disc-shaped emission area and that are capable of supplying current to the disc-shaped emission area such that, when current is applied to the disc-shaped emission area, the disc-shaped emission area heats to a temperature of at least 2000 degrees Celsius with a temperature variation across the emission surface of less than 6% of a maximum temperature achieved.

In a further embodiment, an X-ray tube is provided. The X-ray tube includes an electron beam source. The electron beam source includes an electron emitter configured to emit an electron beam. The electron emitter includes a disc-shaped emission area capable of emitting electrons when heated, comprising a serpentine radial electrical path wherein the serpentine electrical path extends from an outer diameter of the disc-shaped emission area to a center of the disc-shaped emission area and back. The electron emitter also includes a plurality of electrically conductive legs coupled to the electron emitter at respective locations outside the disc-shaped emission area and that are capable of supplying current to the disc-shaped emission area. The X-ray tube also includes an anode assembly configured to receive the electron beam and to emit X-rays when impacted by the electron beam and a housing in which the electron beam source and the anode assembly are disposed.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Provided herein are electron emitters for use in conjunction with a cathode assembly of an X-ray tube. The electron emitters incorporate structural features that result in an electron emission surface with a relatively larger diameter (e.g., in one embodiment having a diameter of about 7 mm to about 11 mm) as compared to existing electron emitters suitable for use in electron gun configurations. Larger emitters such as those disclosed herein result in higher electron emissions at the desired drive current. Drive current refers to the current passing through the emitter to heat it. In one example, the emission is greater than 1250 mA. Further, the electron emitters are capable of maintaining a relatively uniform temperature across the entire electron emission surface, which results in a robust focal spot for imaging purposes. In addition, a lack of hot spots on the emission surface, which is a benefit of relatively uniform temperatures maintained during electron emission, may result in a longer usable life for the emitter, which in turn is cost-effective for maintenance of the X-ray device. Accordingly, the emitters provided may be larger diameter emitters that provide high emission and long usage lives.

To that end, the electron emitters disclosed herein may be used in conjunction with any suitable X-ray device. The operating environment of the disclosure is described with respect to a sixty-four-slice computed tomography (CT) system. While described with respect to an embodiment of a CT scanner, the present techniques are equally applicable to other X-ray based systems, including fluoroscopy, mammography, angiography, and standard radiographic imaging systems as well as radiation therapy treatment systems. Additionally, it will be appreciated by those skilled in the art that the disclosed embodiments are suitable for use with other applications in which an electron gun and/or electron emitter is implemented, whether for x-ray emission or otherwise.

Figure 1:
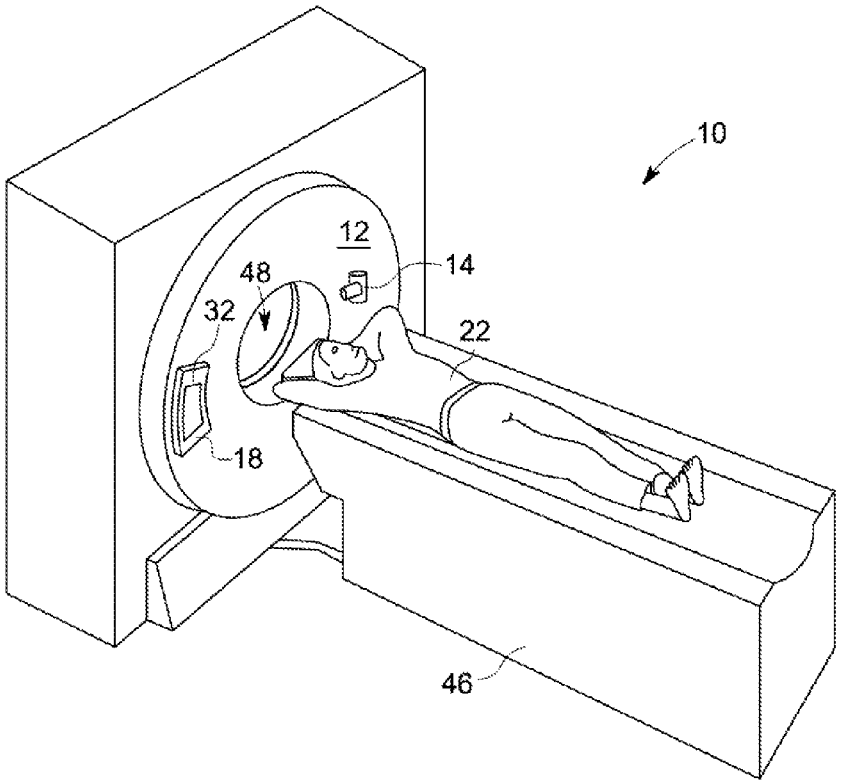
FIG. 1 is a pictorial view of a CT imaging system incorporating an embodiment of the present disclosure.

Referring to FIG. 1, a computed tomography (CT) imaging system 10 is shown as including a gantry 12. The gantry 12 has an X-ray source 14 that projects a beam of X-rays 16 toward a detector assembly on the opposite side of the gantry 12. A detector assembly 18 is formed by a collimator 18, a plurality of detectors 20 and data acquisition system 32. The plurality of detectors 20 (see FIG. 2) sense the projected X-rays that pass through a medical patient 22, and the data acquisition system 32 converts the data to digital signals for subsequent processing. Each detector 20 produces an electrical signal that represents the intensity of an impinging X-ray beam and hence the attenuated beam as it passes through the patient 22. During a scan to acquire X-ray projection data, the gantry 12 and the components mounted thereon rotate about a center of rotation 24.

Figure 2:
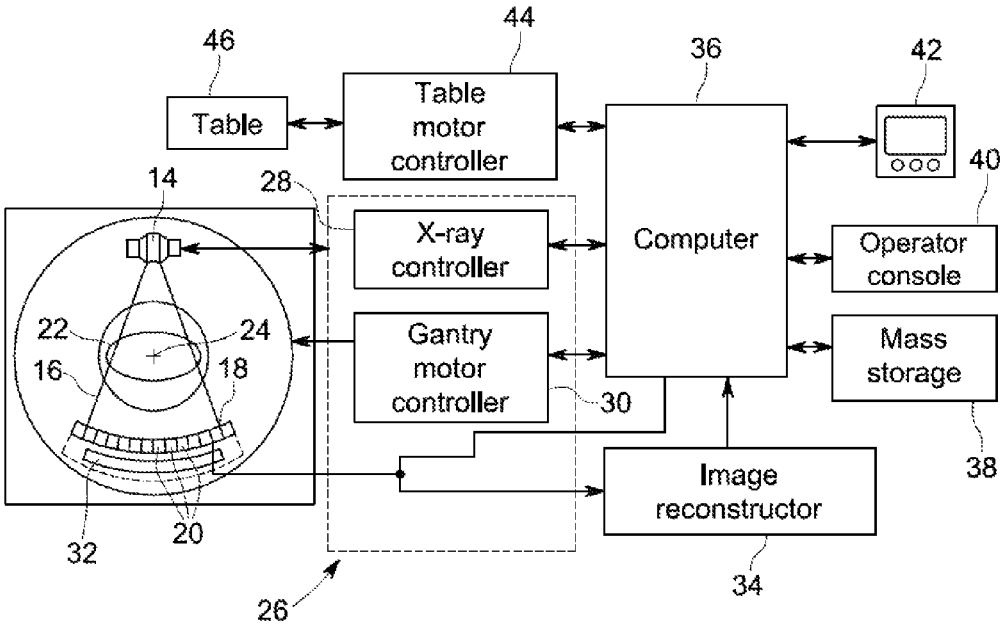
FIG. 2 is a block schematic diagram of the system illustrated in FIG. 1.

Referring to FIG. 2, rotation of the gantry 12 and the operation of X-ray source 14 are governed by a control mechanism 26 of CT system 10. The control mechanism 26 includes an X-ray controller 28 that provides power and timing signals to an X-ray source 14 and a gantry motor controller 30 that controls the rotational speed and position of gantry 12. An image reconstructor 34 receives sampled and digitized X-ray data from the data acquisition system 32 and performs high speed reconstruction. The reconstructed image is applied as an input to a computer 36 that stores the image in a mass storage device 38.

The computer 36 also receives commands and scanning parameters from an operator via a console 40 that has some form of operator interface, such as a keyboard, mouse, voice activated controller, or any other suitable input apparatus. An associated display 42 allows the operator to observe the reconstructed image and other data from the computer 36. The operator-supplied commands and parameters are used by the computer 36 to provide control signals and information to the data acquisition system 32, the X-ray controller 28, and the gantry motor controller 30. In addition, the computer 36 operates a table motor controller 44 that controls a motorized table 46 to position the patient 22 and the gantry 12. In particular, the table 46 moves the patient 22 through a gantry opening 48 of FIG. 1, either in whole or in part.

Figure 3:
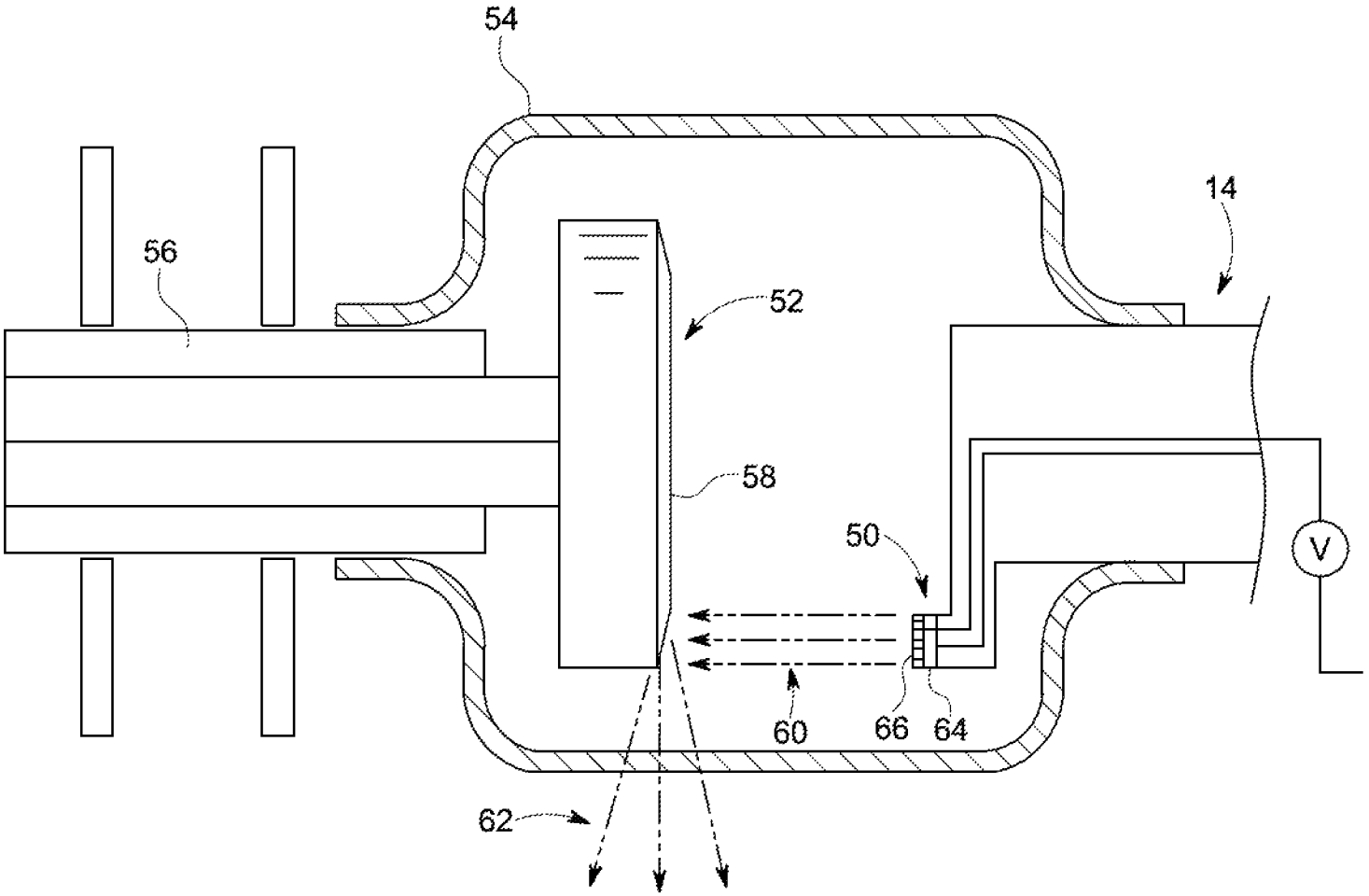
FIG. 3 is a schematic view of an X-ray source in accordance with an embodiment of the present disclosure.

Referring now to FIG. 3, the X-ray source 14 included in CT system 10 is shown in detail. The X-ray source 14 includes an X-ray generating tube 14, which includes a electron gun 50, which may be configured as a Pierce electron gun, and an anode assembly 52 encased in a housing 54. The anode assembly 52 includes a rotor 56 configured to turn a rotating anode disc 58 (i.e., target. When struck by an electron current 60 from the electron gun 50, the anode 58 emits an X-ray beam 62.

Figure 4:
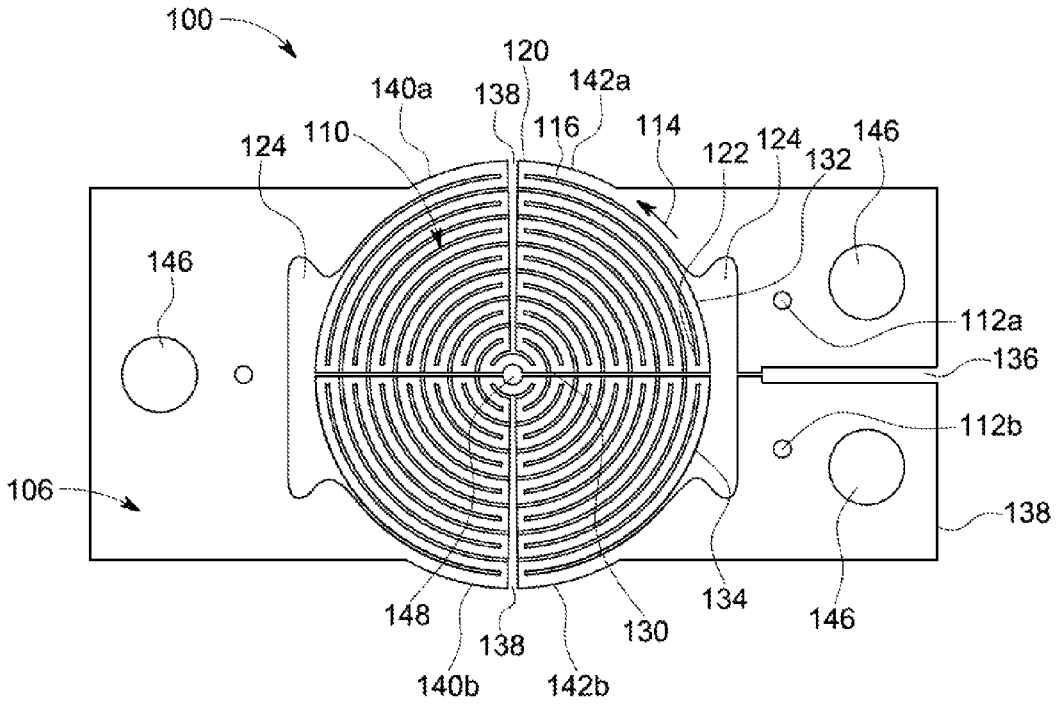
FIG. 4 is a top view of an emitter in accordance with an embodiment of the present disclosure.

The X-ray tube 50 is supported by the anode and cathode assemblies within a housing 54 defining an area of relatively low pressure (e.g., a vacuum). For example, the housing 54 may include glass, ceramics, or stainless steel, or other suitable materials. The anode 58 may be manufactured of any metal or composite, such as tungsten, molybdenum, copper, or any material that contributes to Bremsstrahlung (i.e., deceleration radiation) when bombarded with electrons. The anode's surface material is typically selected to have a relatively thermal diffusivity to withstand the heat generated by electrons impacting the anode 58. The space between the cathode assembly 66 and the anode 58 may be evacuated to minimize electron collisions with other atoms and to increase high voltage stability. Moreover, such evacuation may advantageously allow a magnetic flux to quickly interact with (i.e., steer or focus) the electron beam 62. In some X-ray tubes, electrostatic potential differences in excess of 20 kV are created between the cathode assembly 66 and the anode 58, causing electrons emitted by the cathode assembly 66 to accelerate towards the anode 58. FIG. 4 is a top view of an emitter 100 that may be incorporated as part of the cathode assembly 66 for emission of electrons. The emitter 100 includes a top surface 106 on which an electron emission surface 110 is formed and that emits electrons when heated. Joule heating increases the temperature of the emitter 100 when voltage is applied across the emission surface 110 causing current to flow through the serpentine radial path of each of the four quadrants. By providing an emitter 100 with multiple separate areas (e.g., four quadrants), a larger emitter may be formed. For example, in the depicted four-quadrant pattern, the additional turns may be kept at a desired width and nonetheless maintain the driving current.

The electrical path is shown via arrow 114. The path is radial in that the arrow 114 enters the circle at the outer diameter and follows a pathway to the center of the circle before entering another quadrant of the circle and following a path to the outer diameter again. The top surface 106 includes slots 116 that separate ligaments or segments 120 from one another, thus defining a single serpentine radial electrical path. The slots are sized to define the electrical path and to allow for thermal expansion in the radial direction without shorting between neighboring ligaments or segments 120. In one embodiment, the slots are about 60 μm wide and the segments 120 are about 320 μm wide. The size and number of the segments 120 may be selected to influence the characteristics of the emission surface 110. For example, the segments 120 provide a radial path that changes direction at each turn 122, which is defined by the slots 116 and any other physical separation from the adjacent segments 120. The electrical path winds around the emission surface 110 along the segments 120, changing direction at the turns 122. An electrical path with more turns 122 (and more segments 120) may result in improved temperature uniformity and smaller driving current. However, an emitter 100 with more turns 122 may be more complex to manufacture. Further, the width of the turns 122 may be adjusted to compensate for any hot spots, thereby improving the temperature uniformity of the emission surface when in operation.

The flow of electricity across the top surface 106 and within the emission surface 110 results in the heating of the emission surface 110 and eventual electron emission when the emitter 100 reaches sufficiently high temperatures. In certain embodiments, the emitter 100 may include any suitable materials to facilitate electron emission, including tungsten, hafnium carbide (HfC), or other materials. Further, although the emitter 100 is depicted as featuring a flat top surface 106 (and emission surface 110) it should be understood that the emitter 100, in certain embodiments, may be curved or otherwise nonplanar.

The emitter 100 may also include additional features that define the electrical path, including passageways 124 that electrically separate the terminal 112*a* from other terminals (e.g. terminal 112*b*). A channel 130 separates a top half 132 of the emission surface 110 from a bottom half 134, further preventing the segments 120 from having multiple paths within the emission surface. As illustrated, the channel 130 bisects the emission surface 110. The channel 130 may separate the emission surface into substantially equal portions, depending on the shape of the emission surface. The channel 130 may also extend past the emission surface 110 into a wider notch 136 that terminates at an end 138 of a longest dimension of the emitter 100.

The emitter 100 may also include one or more v-shaped gaps 138 that partially separate portions of the emission surface 110 from one another. For example, the depicted embodiments shows two v-shaped, i.e., tapered, gaps 138 that separate left quadrants (140*a* and 140*b*) from right quadrants (142*a* and 142*b*) of the emission surface 110. As illustrated, the v-shaped gaps 138 leave a single electrical path between the left quadrants 140 and the right quadrants 142. In one embodiment, the v-shaped gaps 138 are aligned along an axis (e.g., a diameter axis). In another embodiment, the v-shaped gaps 138 are orthogonal to the channel 130.

The emitter 100 may also include temperature uniformity features that facilitate cooling or distribution of heat across the emission surface. For example, the size and shape of the passageways 124 may be selected to distribute heat. Passageways 146 may also be formed in the emitter 100 for this purpose. The passageways 146 may also be used as alignment holes for positioning the emitter 100 within the cathode assembly 66. In addition, the channel 130 may include heat distribution features, such as a hole 148 formed in the center of the emission surface 110. The hole 148 may be any suitable shape that facilitates regulating or smoothing the temperature. In one embodiment, the hole 148 has a diameter of about 550 μm.

Figure 5:
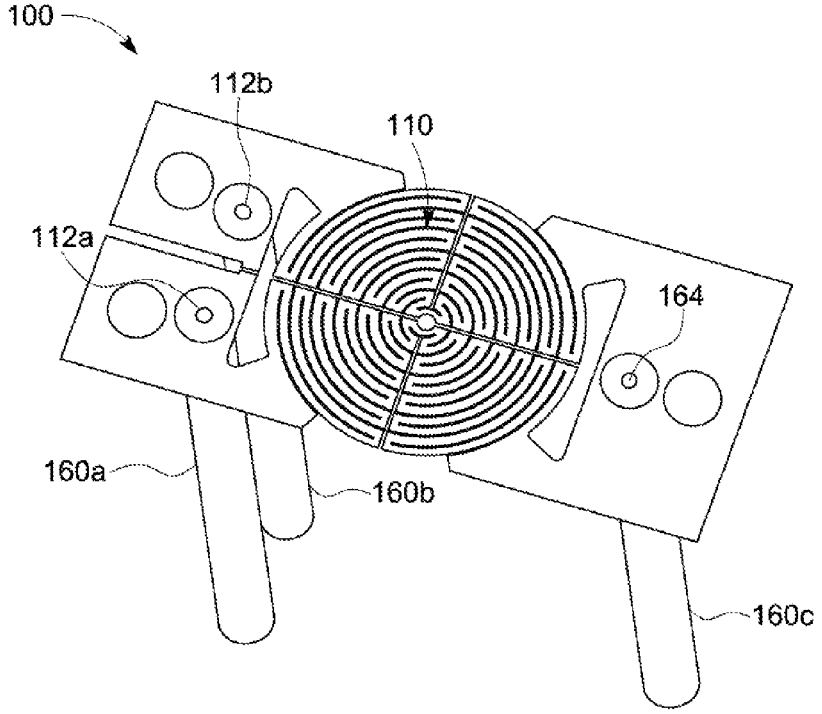
FIG. 5 is a perspective view of the emitter of FIG. 5 in accordance with an embodiment of the present disclosure.

FIG. 5 is a perspective view of the emitter 100 showing the posts 160. The post 160*a* is electrically coupled to the terminal 112*a* and provides electrical current. Similarly, the post 160*b* is coupled to the terminal 112*b*. The post 160*c* is not electrically conductive and is coupled to the emitter 100 at junction 164. This coupling, whether fixed or sliding, provides structural support to hold the emitter in-plane. It should be understood that the positions of the posts 160 and the terminals 112 may be exchanged. Further, the emitter 110 may be configured with a two-post arrangement rather than a three-post arrangement. The posts may be affixed in any suitable manner to the emitter 100. In one embodiment, the posts 160 are laser welded to the emitter 100. In one embodiment, the posts 160 are coupled to the emitter 100 at positions outside of the emission surface 110.

Figure 6:
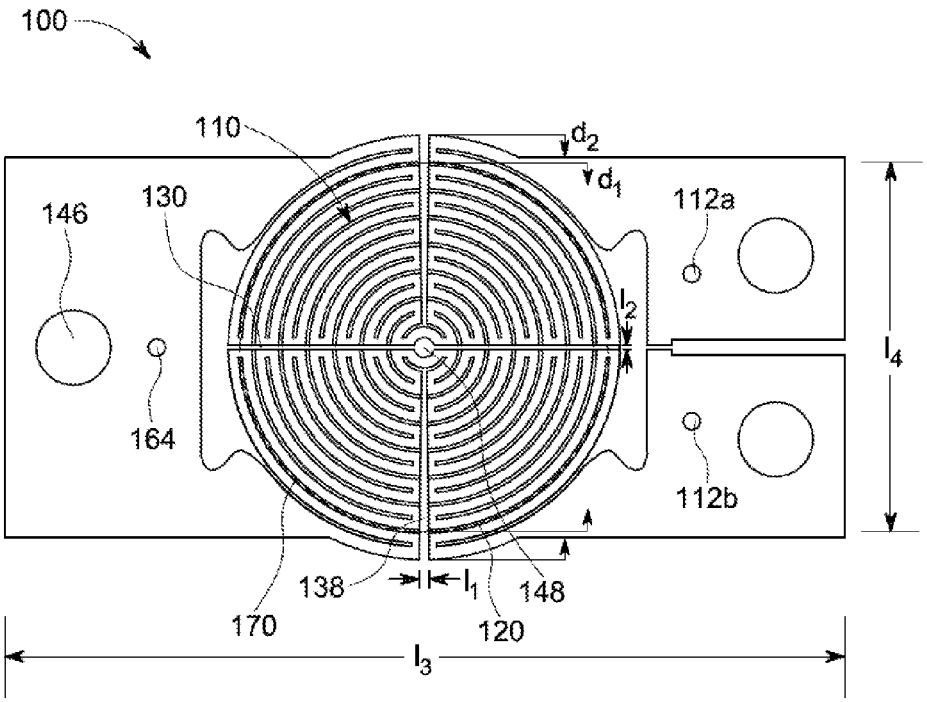
FIG. 6 is a top view of the emitter of FIG. 5 in which an emission surface is marked in accordance with an embodiment of the present disclosure.

The posts 160 are coupled to the emitter 100 outside an area defining the emission surface 110. FIG. 6 illustrates the emission surface 110 as being within the circle defined by a dotted line 170. In the depicted embodiment, the diameter $d_1$ of the emission surface may be at least about 7 mm or at least about 10 mm. The emitter 100 forms a circle with a diameter $d_2$ that extends outside of the emission surface 110, such that the longest segment 120 is at least in part outside the emission surface 110. In certain embodiments, the diameter $d_1$ is about 10 mm and the diameter $d_2$ is about 11.5 mm.

As noted, the emitter may include one or more features that separate the generally round emitter 100 into different section or quadrants. For example, such features may include one or more v-shaped gaps 138. The size and shape of the v-shaped gaps 138 may be selected to allow thermal expansion of the segments 120. The emitter 100 is configured to expand within the one or more v-shaped gaps 138 when heated such that the one or more v-shaped gaps 138 decreases in size without permitting adjacent lobes or sections to touch one another. In particular, the v-shaped gaps may be generally wider as they extend radially away from the center of the emitter 100. This allows longer segments 120 located towards the outer circumference of the emitter 100 to expand more than relatively shorter segments 120. Shorter segments 120 may expand less, which facilitates a relatively narrower gap. The size of the v-shaped gaps 138 may be selected to permit expansion but also to minimize loss of emission area.

The v-shaped gaps 138 taper towards the center of the emission surface 110 such that the gap length varies and is narrowest towards the hole 148. At the widest point, the gap length $l_1$ may be 260 μm or less. In one embodiment, the v-shaped gap 138 may have a gap length that varies between about 120 μm to about 240 μm. Further, the v-shaped gap 138 may be characterized by a ratio of a widest gap length $l_1$ to a narrowest gap length of about 2 or more. That is, the widest point of the v-shaped gap 138 may be twice as wide or more as the narrowest point. The channel 130 may have a gap length $l_2$ that is a generally constant size. In one embodiment, the gap length $l_2$ of the channel 130 is less than about 240 μm. In another embodiment, the gap length $l_2$ of the channel 130 is between about 120 μm to about 240 μm.

The size and shape of the emitter 100 may be selected based on suitable dimensions to be used in conjunction with the cathode assembly 66, including cathode support 64. In a particular embodiment, the longer dimension $l_3$ of the emitter 100 may be about twice the diameter of the emission surface 110. In one embodiment, the longer dimension $l_3$ may be within 1-2 mm, longer or shorter, than twice the diameter of the emission surface 110. In another embodiment, the shorter dimension $l_4$ of the emitter 100 may be about the diameter of the emission surface 110.

Figure 7:
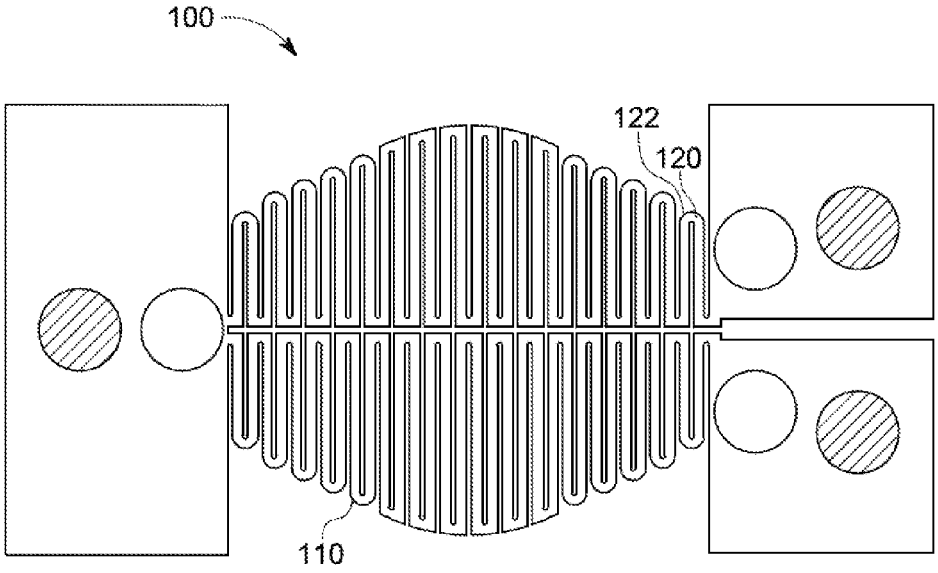
FIG. 7 is a top view of an alternate embodiment of an emission surface with an axial current path.

FIG. 7 is an alternate embodiment of the emitter 100 in which the emission surface 110 is configured so that the electrical path is generally axial, which in the depicted embodiment results in a generally elliptical emission surface 110. The segments 120 include turns 122 that define an electrical path that changes direction about 180 degrees at each turn 122.

The emitter 100 is capable of achieving emission temperatures with relatively larger emission surface diameters (e.g., at least 7 mm) with drive currents of about 7-9.5 Amps. This arrangement provides scaling up of emission surface diameter and improved electron emission characteristics without undesirable scaling up of the associated drive current. In one embodiment, the emission surface 110 may be any suitable shape or configuration that achieves this effect. For example, the emission surface 110 may be generally round, disc-shaped, circular, annular, elliptical, or rectangular.

Regardless of the pattern used on forming the emitter 100, the temperature distribution across the emission surface 100 is relatively uniform at operational drive currents. Table 1 shows the results of expected temperature profiles for the radial (10 mm diameter) and axial designs as modeled using thermal modeling software.

TABLE 1

| | Drive Current (A) | Tmax (° C.) | ΔT (° C.) |
|---|---|---|---|
| Radial pattern | 9.5 | 2601 | 124 |
| Axial Pattern | 7.5 | 2641 | 150 |

As shown, the temperature uniformity for the radial pattern remained consistent even at maximum drive currents. In one embodiment the emitter 100 maintains temperature uniformity across the emission surface 110 of less than about 10% or less than about 6% temperature difference from the maximum temperature.

This written description uses examples, including the best mode, and also to enable any person skilled in the art to practice the techniques, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An electron emitter comprising:

a surface comprising a round emission area which is a circle capable of emitting electrons when heated, wherein the round emission area comprises slots that separate segments from one another and define a radial electrical path; and at least one of a gap, a channel, or a combination thereof that separates a first portion of the round emission area from a second portion of the round emission area and permits thermal expansion of the first portion and the second portion within the at least one gap or channel without permitting the first portion and the second portion to touch one another wherein the radial electrical path begins at an outer diameter of the circle at the first portion and follows a pathway through the first portion to the center of the circle before entering the second portion, further comprising at least a second gap or channel orthogonal to the at least one gap or channel and divides the first portion and the second portion into equal portions that form at least four quadrants;

two electrically conductive legs coupled to the surface at respective locations outside the round emission area and that are capable of supplying current to the round emission area; and at least one leg not electrically conductive and couple to the electron emitter to provide structural support and hold the electron emitter in-plane within at least two planes.

2. The electron emitter of claim 1, wherein the first portion and the second portion are separate areas that form quadrants.

3. The electron emitter of claim 2, wherein a diameter of the circle is at least 7 mm.

4. The electron emitter of claim 2, wherein the round emission area comprises at least one v-shaped gap that narrows towards a center of the circle.

5. The electron emitter of claim 4, wherein the v-shaped gap narrows from a widest gap length that is about twice a narrowest gap length.

6. The electron emitter of claim 4, wherein the surface comprises both a v-shaped gap and a channel.

7. The electron emitter of claim 1, wherein the round emission area comprises at least two v-shaped gaps.

8. The electron emitter of claim 1, wherein the gap, the channel, or the combination thereof, bisects the surface and extends past the round emission area into a wider notch that terminates at an end of a longest dimension of the electron emitter.

9. The electron emitter of claim 1, wherein the round emission area comprises a hole at a midpoint of the round emission area.

10. The electron emitter of claim 1, wherein the emitter comprises tungsten hafnium carbide or a combination thereof.

11. An electron emitter comprising:

a surface comprising a disc-shaped emission area separated into quadrants and capable of emitting electrons when heated with a driving current of 10 A or less; and two electrically conductive legs coupled to the surface at respective locations outside the disc-shaped emission area and that are capable of supplying current to the disc-shaped emission area such that, when current is applied to the disc-shaped emission area, the disc-shaped emission area heats to a temperature of at least 2000 degrees Celsius with a temperature variation across the emission surface of less than 6% of a maximum temperature achieved when the disc-shaped emission area is heated; and a non-electrically conductive leg coupled to the surface to provide structural support to hold the electron emitter in-plane; and at least one leg not electrically conductive and couple to the electron emitter to provide structural support and hold the electron emitter in-plane within at least two planes.

12. The electron emitter of claim 11, wherein the disc-shaped emission area comprises a circle.

13. The electron emitter of claim 12, wherein a diameter of the circle is at least 7 mm.

14. The electron emitter of claim 12, wherein a diameter of the circle is between about 7 mm and about 11 mm.

15. The electron emitter of claim 12, wherein the emitter comprises an annular region surrounding the emission surface that is not part of the emission surface.

16. The electron emitter of claim 11, wherein the disc-shaped emission area comprises an ellipse.

17. The electron emitter of claim 11, wherein the disc-shaped emission area heats to a temperature of at least 2000 degrees Celsius with a temperature variation across the emission surface of less than 6% of a maximum temperature achieved at a driving current between about 7.5 A and about 9.5 A.

18. An X-ray tube comprising:

an electron beam source comprising an electron emitter configured to emit an electron beam, wherein the electron emitter comprises:

a disc-shaped emission area comprising at least a first portion and a second portion, and capable of emitting electrons when heated, and further comprising a serpentine electrical path wherein the serpentine electrical path extends from an outer diameter of the disc-shaped emission area at the first portion to a center of the disc-shaped emission area before entering the second portion; further comprising at least a second gap or channel orthogonal to the at least one gap or channel and dividing the first portion and the second portion into equal portions that form at least four quadrants; and a plurality of electrically conductive legs coupled to the electron emitter at respective locations outside the disc-shaped emission area and that are capable of supplying current to the disc-shaped emission area; and a post not electrically conductive and coupled to the electron emitter to form a three-post arrangement that holds the electron emitter in-plane within at least two planes;

an anode assembly configured to receive the electron beam and to emit X-rays when impacted by the electron beam; and a housing in which the electron beam source and the anode assembly are disposed.

19. The X-ray tube of claim 18, wherein the disc-shaped emission area comprises a circle having a diameter greater than about 7 mm.

20. The X-ray tube of claim 19, wherein the disc-shaped emission area comprises at least one v-shaped gap that narrows towards a center of the circle, separate from and partially separates portions of the disc-shaped emission area.

21. The X-ray tube of claim 20, wherein the disc-shaped emission area comprises a hole at a center of the circle independent from the v-shaped gaps to facilitate regulating temperature.

22. The X-ray tube of claim 18, wherein the disc-shaped emission area comprises a plurality of lobes.

23. The X-ray tube of claim 22, wherein at least a portion of the plurality of lobes are separated by one or more V-shaped gaps and wherein the disc-shaped emission area is configured to expand within the one or more V-shaped gaps when heated such that the one or more V-shaped gaps decreases in size without permitting adjacent lobes to touch one another.

* * * * *